US006260200B1

(12) United States Patent
Alfred

(10) Patent No.: US 6,260,200 B1
(45) Date of Patent: Jul. 17, 2001

(54) GARMENT WHICH RESTRICTS UNASSISTED DISROBING

(76) Inventor: Veena J. Alfred, 5520 Muncaster Mill Rd., Rockville, MD (US) 20855

( * ) Notice: Subject to any disclaimer, the term of this patent is extended or adjusted under 35 U.S.C. 154(b) by 0 days.

(21) Appl. No.: 09/459,456

(22) Filed: Dec. 13, 1999

(51) Int. Cl.[7] ..... A41D 1/00
(52) U.S. Cl. ..... 2/69; 2/79; 2/83
(58) Field of Search ..... 2/79, 114, 227, 2/80, 75, 83, 69, 265; D2/838

(56) References Cited

U.S. PATENT DOCUMENTS

| | | | | |
|---|---|---|---|---|
| D. 155,796 | * | 11/1949 | Fischer | D3/4 |
| D. 311,986 | * | 11/1990 | Beavers, Sr. | D2/183 |
| 2,802,215 | * | 8/1957 | Alfandre | 2/265 |
| 3,397,406 | * | 8/1968 | Leach | 2/96 |
| 4,853,977 | * | 8/1989 | Foreman | 2/114 |
| 5,084,914 | * | 2/1992 | Hesch | 2/79 |
| 5,208,918 | * | 5/1993 | Royal | 2/114 |
| 5,553,323 | * | 9/1996 | Chou et al. | 2/114 |
| 5,752,277 | * | 5/1998 | Van Der Sleesen | 2/69 |
| 5,822,802 | * | 10/1998 | Chou | 2/227 |
| 5,887,279 | * | 3/1999 | Elting et al. | 2/69 |
| 5,911,312 | * | 6/1999 | Holyfield | 2/69 |

* cited by examiner

*Primary Examiner*—John J. Calvert
*Assistant Examiner*—Alissa L. Hoey
(74) *Attorney, Agent, or Firm*—Liniak, Berenato, Longacre & White, LLC

(57) ABSTRACT

A garment is provided which restricts unassisted disrobing. The garment preferably facilitates assisted disrobing in a key-less manner and has decorative features which resemble traditional clothing. The garment comprises front and rear panels of clothing material, an opening preferably in the rear panel, an operable closure device, and a cover for an actuator of the operable closure device. The front panel of clothing material is adapted to cover at least a front portion of the wearer's body. The rear panel is adapted to cover at least a rear portion of the wearer's body. The opening facilitates donning of the garment. The operable closure device is located at the opening and is operable to at least partially close the opening to thereby prevent removal of the garment. The operable closure device extends into an inaccessibility zone of the rear panel. The inaccessibility zone is arranged so that, when the garment is donned, the inaccessibility zone is located between the wearer's shoulder blades at a predetermined distance from the neck of the wearer. The operable closure device has an actuator which is movable along the operable closure device to effect opening or closing of the opening. The cover for the actuator is located substantially at the inaccessibility zone. The cover is selectively closable to prevent access to the actuator when the actuator is positioned in the inaccessibility zone. Preferably, at least one operable fastener and at least one simulated fastener are provided at or near the cover.

20 Claims, 3 Drawing Sheets

GARMENT WHICH RESTRICTS UNASSISTED DISROBING

BACKGROUND OF THE INVENTION

The present invention relates to a garment which restricts unassisted disrobing, and which is particularly well-suited for use on, among others, patients who are in advanced stages of Alzheimer's disease, or on people who otherwise have a tendency to disrobe in inappropriate places or at inappropriate times.

It is known that some people, such as patients who are in advanced stages of Alzheimer's disease, have a tendency to undress in inappropriate places or at inappropriate times. This is especially problematic in the assisted living environment. Prior attempts to prevent such inappropriate undressing have included, for example, restraining the person using a restraint garment or locking the clothing onto the person using a locking mechanism, which locking mechanism only permits disrobing when a key is used.

Such locking mechanisms, however, can prevent or hamper assistance from those who do not have a key. In addition, in assisted living environments, there are regulations which preclude the use of locking mechanisms or restraints. Restraints are less than ideal for other reasons as well. They are believed to have a negative impact on the wearer's dignity and can significantly hamper legitimate activity. There is consequently a need for a garment which restricts unassisted disrobing, without restraining the wearer and/or without requiring a key when disrobing assistance is to be provided.

Alzheimer's disease patients have exhibited a tendency to play with fasteners (e.g., buttons, snaps and the like), closure devices (e.g., zippers and the like), and belts and belt buckles. This tendency is believed to play a significant role in the observed actions of some patients to undress in inappropriate places and at inappropriate times. There is consequently a need for a garment having belt buckles, fasteners and/or closure devices which are manually actuatable by the wearer without facilitating unassisted disrobing.

Many conventional restraint garments and garments with features adapted to restrict undressing have little in common with traditional clothing. The noticeable differences between such garments and traditional clothing also are believed to have a negative impact on the wearer's dignity.

SUMMARY OF THE INVENTION

A primary object of the present invention is to satisfy at least one of the foregoing needs and/or solve at least one of the aforementioned problems by providing a garment adapted to restrict disrobing.

Another object of the present invention is to provide a garment having minimal differences in appearance from traditional clothing, despite being adapted to restrict unassisted disrobing.

Still another object of the present invention is to provide a garment adapted to restrict unassisted disrobing and having belt buckles, fasteners and/or closure devices which are manually actuatable by the wearer in a way that does not facilitate unassisted disrobing.

Yet another object of the present invention is to provide a garment which restricts unassisted disrobing, but without restraining the wearer and/or without requiring a key when disrobing assistance is being provided.

To achieve these and other objects, the present invention provides a garment adapted to restrict unassisted disrobing by a wearer. The garment comprises front and rear panels of clothing material, an opening in the rear panel, an operable closure device, and a cover for an actuator of the operable closure device. The front panel of clothing material is adapted to cover at least a front portion of the wearer's body. The rear panel is adapted to cover at least a rear portion of the wearer's body. The opening in the rear panel facilitates donning of the garment. The operable closure device is located at the opening and is operable to at least partially close the opening to thereby prevent removal of the garment. The operable closure device extends into an inaccessibility zone of the rear panel. The inaccessibility zone is arranged so that, when the garment is donned, the inaccessibility zone is located between the wearer's shoulder blades at a predetermined distance from the neck of the wearer. The operable closure device has an actuator which is movable along the operable closure device to effect opening or closing of the opening. The cover for the actuator is located substantially at the inaccessibility zone. The cover is selectively closable to prevent access to the actuator when the actuator is positioned in the inaccessibility zone.

The present invention also provides a garment adapted to restrict unassisted disrobing by a wearer, wherein the garment comprises clothing material, an opening in the clothing material, an operable closure device, a cover for an actuator of the operable closure device, at least one operable fastener, and at least one simulated fastener. The clothing material is adapted to cover a portion of the wearer's body. The opening in the clothing material facilitates donning of the garment. The operable closure device is located at the opening and is operable to at least partially close the opening to thereby prevent removal of the garment. The operable closure device has an actuator which is movable along the operable closure device to effect opening or closing of the opening. The cover for the actuator is adapted to extend over the actuator and prevent operation of the actuator when the actuator is positioned so as to effect closure of the operable closure device. The cover is secured to the clothing material on one side of the opening. The operable fastener(s) is (are) adapted to removably secure the cover to the clothing material at an opposite side of the opening, while the cover extends over the actuator. The simulated fastener(s) is (are) located on or about the cover, to distract the wearer from the operable fastener(s) and from the operable closure device.

Also provided by the present invention is a garment adapted to restrict unassisted disrobing by a wearer and adapted to facilitate assisted disrobing in a keyless manner. The garment comprises front and rear panels of clothing, an opening in the rear panel, an operable closure device, and a cover for an actuator of the operable closure device. The front panel of clothing material is adapted to cover at least a front portion of the wearer's body. The rear panel is adapted to cover at least a rear portion of the wearer's body. The opening in the rear panel facilitates donning of the garment. The operable closure device is located at the opening and is operable to at least partially close the opening to thereby prevent removal of the garment. The operable closure device extends into an inaccessibility zone of the rear panel. The inaccessibility zone is arranged so that, when the garment is donned, the inaccessibility zone is located between the wearer's shoulder blades at a predetermined distance from the neck of the wearer. The operable closure device has an actuator which is movable along the operable closure device to effect opening or closing of the opening in a keyless manner. The cover for the actuator of the operable closure device is located substantially at the inaccessibility zone. The cover is selectively closable to prevent access to the actuator when the actuator is positioned in the inaccessibility zone.

The above and other objects and advantages will become more readily apparent when reference is made to the following description taken in conjunction with the accompanying drawings.

DESCRIPTION OF PREFERRED EMBODIMENTS

Figure 1:
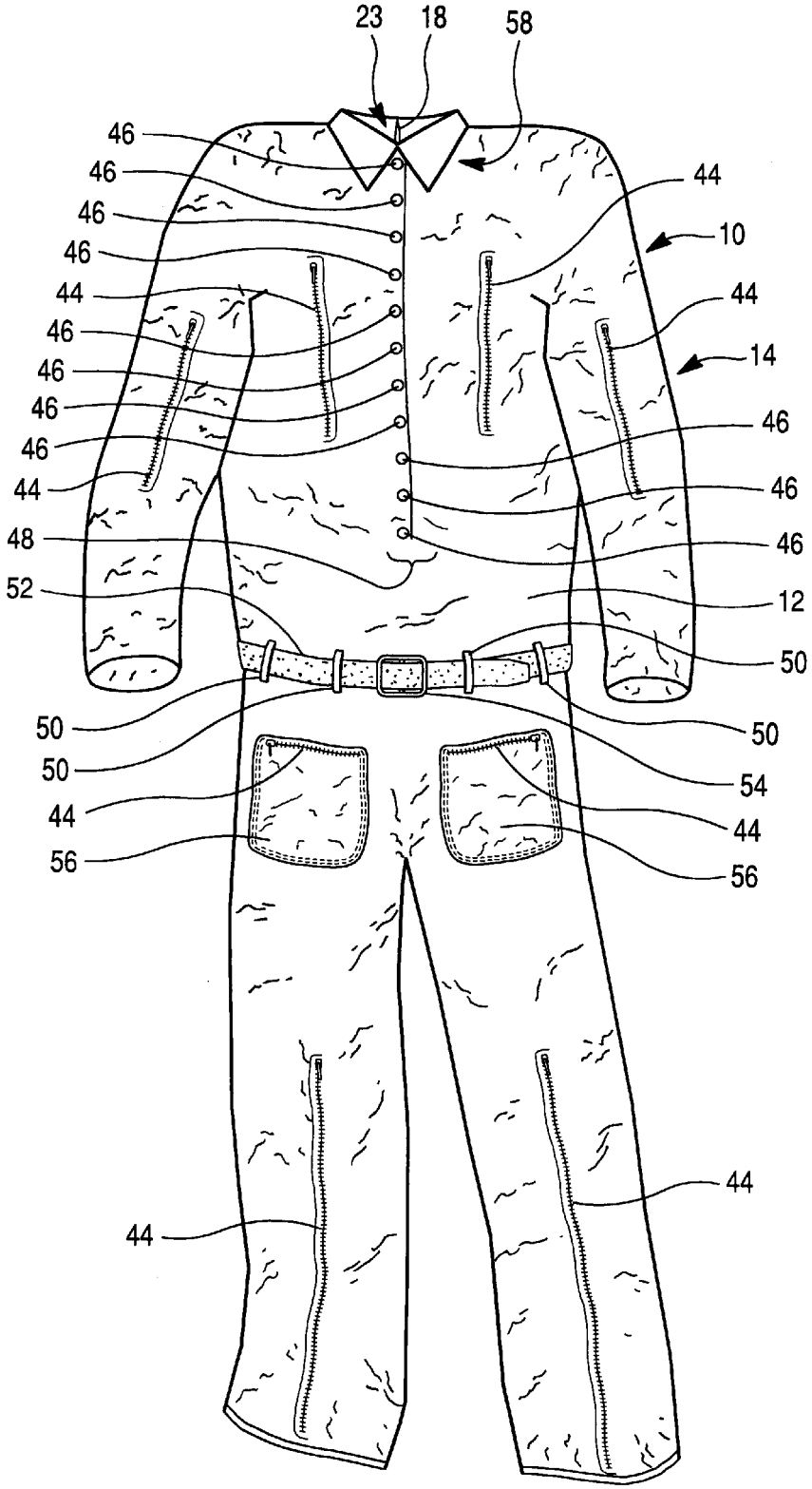
FIG. 1 is a front view of a garment adapted to restrict unassisted undressing according to a preferred embodiment of the present invention.
Figure 2:
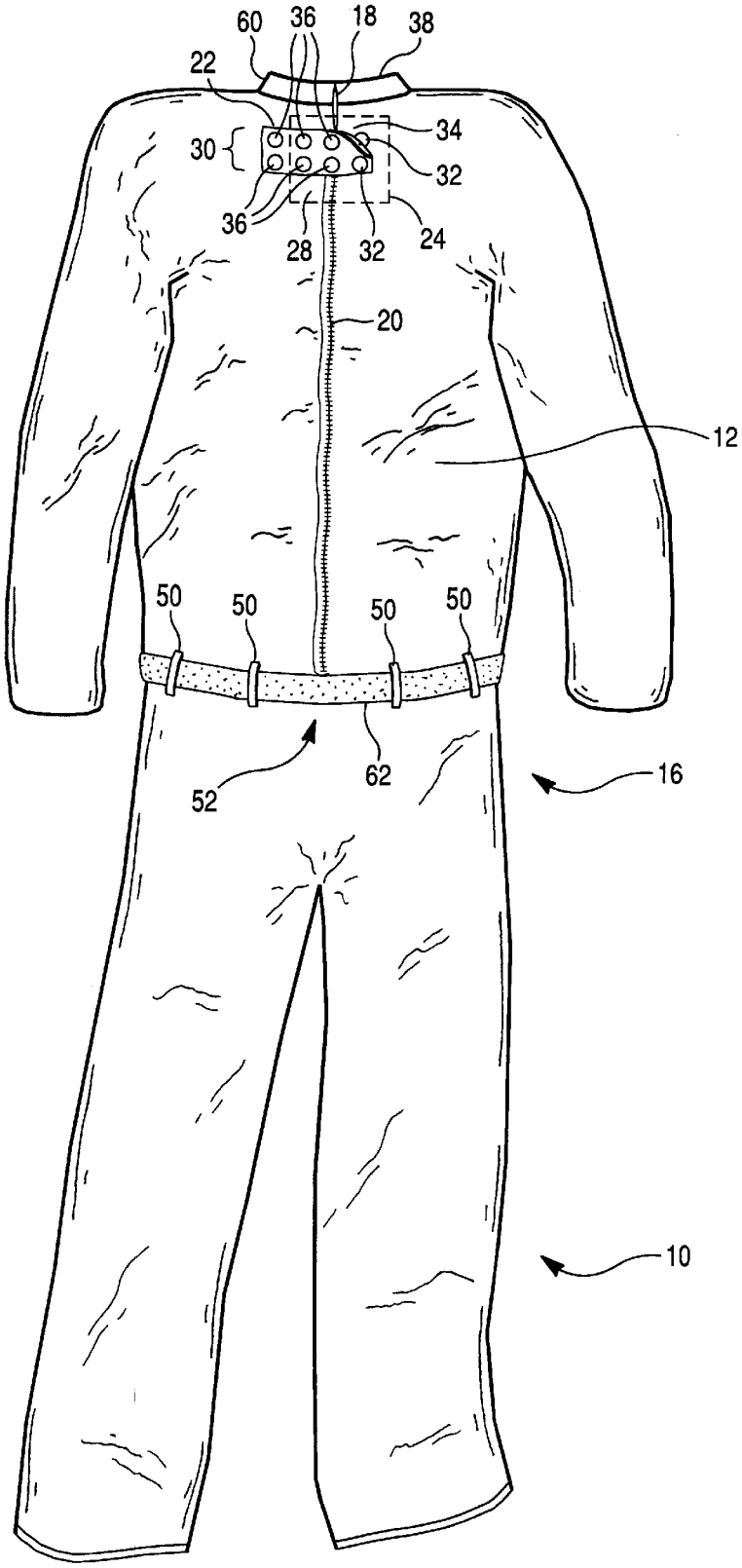
FIG. 2 is a rear view of the garment shown in FIG. 1, wherein a cover associated with the garment is shown in a partially fastened configuration.
Figure 3:
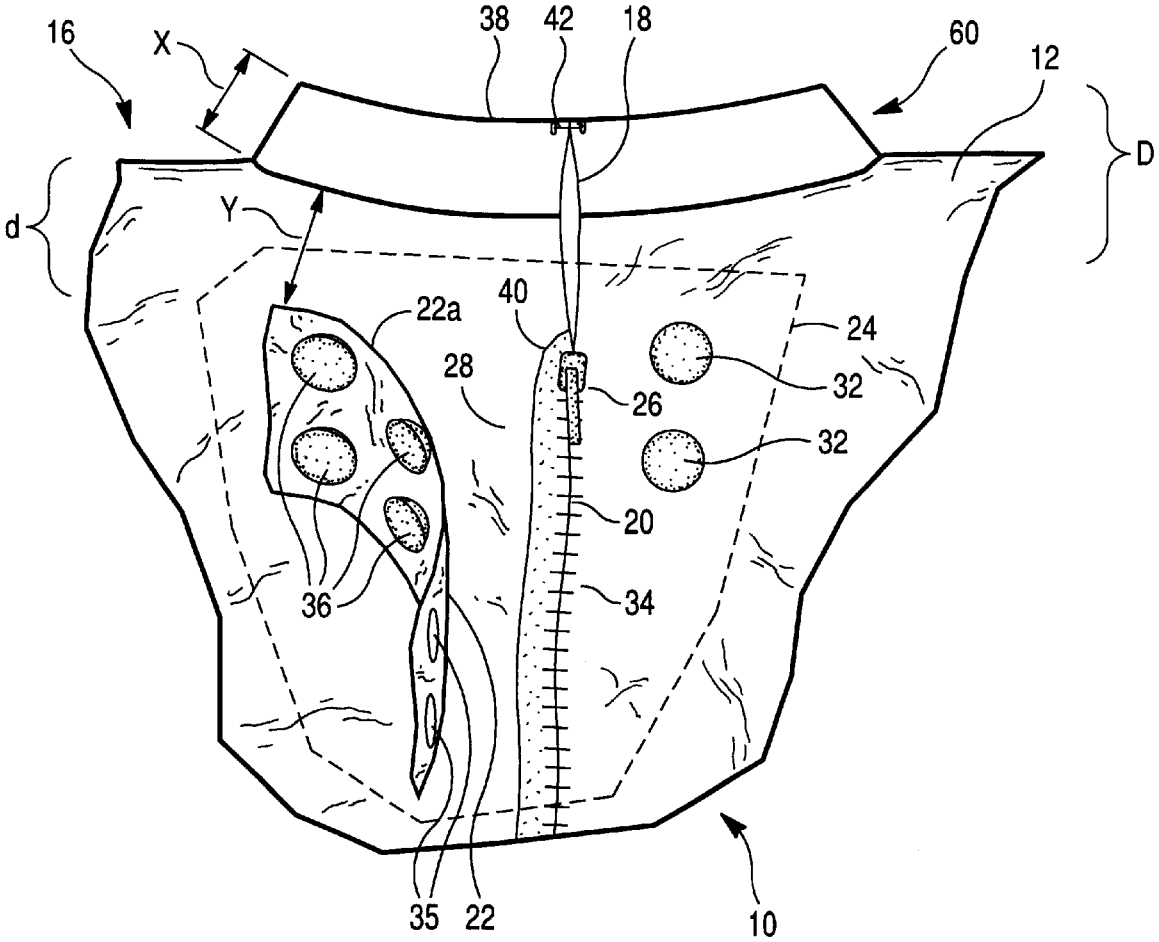
FIG. 3 is a fragmentary view of the garment shown in FIGS. 1 and 2, wherein the cover is shown in an unfastened configuration.

With reference to FIGS. 1–3, a preferred embodiment of the present invention is provided in the form of a garment 10 adapted to restrict unassisted disrobing by a wearer. The garment 10 comprises clothing material 12 defining front and rear panels 14,16, an opening 18, an operable closure device 20, and a cover 22 for the operable closure device 20.

The front panel 14 of clothing material 12 is adapted to cover at least a front portion of the wearer's body. While the exemplary front panel 14 covers the front of a wearer's arms, legs, torso, and pelvic region, it is understood that the invention is not limited to such an arrangement. Generally, it suffices to have the front of the torso and the front of the pelvic region covered by the front panel 14.

The rear panel 16 likewise is adapted to cover at least a rear portion of the wearer's body. While the exemplary rear panel 16 covers the back of the wearer's arms, legs, torso, and pelvic region, it is understood that the invention in not limited to such an arrangement. It generally suffices to have the back of the torso and the back of the pelvic region covered by the rear panel 16. The panels 14,16 can be made of the same or a different material. The connection of the front and rear panels 14,16 need not involve a seam. To the contrary, this connection can be provided by integrally forming the front panel 14 with the rear panel 16. In this regard, a unitary construction can be provided.

The operable closure device 20 is located along the opening 18 and is operable to at least partially close the opening 18. The opening 18 is large enough to accommodate the wearer's body as the garment 10 is donned. In particular, the wearer's body is accommodated either through the opening 18 itself, or through a combination of the opening 18 and a neck hole 23 of the garment 10. Preferably, the opening 18 is located in the rear panel 16 to complicate or prevent access to the closure device 20 by the wearer after the opening 18 is closed by the closure device 20.

When the opening 18 is closed, removal of the garment 10 is prevented or at least made extremely difficult. FIGS. 2 and 3 show the closure device 20 in its closed configuration, whereby a majority of the opening 18 (i.e., the portion of the opening along which the closure device 20 extends) is closed.

The operable closure device 20 extends into an inaccessibility zone 24 of the rear panel 16. When the garment 10 is donned, the inaccessibility zone 24 is located between the wearer's shoulder blades at a predetermined distance (d) from the neck of the wearer. This inaccessibility zone 24 cannot be reached by the typical wearer, or at least cannot be reached without considerable difficulty.

The operable closure device 20 has an actuator 26 which is movable along the operable closure device 20 to effect opening or closing of the opening 18. When the actuator 26 is located in the inaccessibility zone 24, as shown in FIGS. 2 and 3, the closure device 20 closes the opening 18 at least partially. Since it is difficult, if not impossible, for the wearer to reach the actuator 26 when the actuator 26 is located in the zone 24, such positioning of the actuator 26 prevents unassisted opening of the closure device 20 by the wearer.

Preferably, the operable closure device 20 is a zipper which is closed when the actuator 26 of the zipper reaches the inaccessibility zone 24. The present invention, however, is not limited to zipper-based closure devices 20. Other closure devices can be used, such as slide fasteners, laces, and the like.

To further prevent, or at least complicate, unassisted disrobing, the aforementioned cover 22 is provided for the actuator 26. The cover 22 is located substantially at the inaccessibility zone 24 and is selectively closable to prevent access to the actuator 26 when the actuator 26 is positioned in the inaccessibility zone 24.

The cover 22 preferably is secured (permanently or removably) to the rear panel 16 on one side 28 of the opening 18. In the illustrated embodiment, the cover 22 is sewn to the rear panel 16 on the first side 28 of the opening 18. It is understood, however, that other permanent or temporary anchoring techniques can be used. While the cover 22 preferably is implemented as a flap of the clothing material 12, it is understood that the invention is not limited to such arrangements.

The cover 22 also extends across at least a portion 30 of the opening 18, which portion 30 is located in the inaccessibility zone 24. At least one operable fastener 32 is provided on the cover 22 or on the rear panel 16, at an opposite side 34 of the opening 18. The operable fastener(s) 32 is (are) adapted to removably secure the cover 22 to the rear panel 16 at the opposite side 34 of the opening 18. In the preferred embodiment, two fasteners 32 are provided because the cover 22 is rather wide. The invention, however, can be practice using only one or any desired number of operable fasteners 32. When the two fasteners 32 are used to secure the cover 22 to the opposite side 34 while the closure device 20 is in its closed configuration, the cover 22 blocks access to the actuator 26 and thereby prevents opening of the closure device 20.

In FIGS. 2 and 3, the operable fastener(s) 32 are provided in the form of buttons. The buttons 32 can be sewn onto the material 12 at the opposite side 34 of the opening 18. Suitable button holes 35 are provided for the buttons 32. When the buttons 32 are received in the button holes 35, the cover 22 remains removably secured across the opening 18. Access to the actuator 26 thus is restricted. While the buttons 32 represent a preferred implementation of the operable fastener(s) 32, it is understood that the invention can be practiced using alternative forms of operable fasteners 32 (e.g., snaps, zippers, laces, and the like).

The cover 22 also need not be arranged so as to cover the actuator 26 when the actuator 26 is in the full closing position. The cover 22, in this regard, can be located at the bottom of the inaccessibility zone 24, while the operable closure device 20 extends to the top of the inaccessibility zone 24. Unassisted disrobing therefore would require the wearer to be limber enough to initially reach the actuator 26 at the top of the inaccessibility zone 24 and to also push the actuator 26 down through the zone 24 to the bottom thereof, and would also require the wearer to be limber enough to reach the bottom of the inaccessibility zone 24 with sufficient dexterity to locate and unfasten the operable fastener(s) 32 associated with the cover 22.

Preferably, the cover 22 also includes at least one simulated fastener 36 adapted to distract the wearer from the operable fastener(s) 32 and from the operable closure device 20. The exemplary embodiment of the cover 22 shown in FIGS. 2 and 3 includes a set of six simulated fasteners 36. If the wearer happens to be sufficiently limber to reach into the inaccessibility zone 24, the simulated fasteners 36 may provide enough of a distraction to prevent unbuttoning of the operable fastener(s) 32.

The simulated fasteners 36 preferably feel the same, when touched, as do the operable fasteners 32. This makes it difficult, if not impossible, for the wearer to distinguish the operable fasteners 32 from the simulated ones 36. Alternatively, the simulated fasteners 36 can be made more prominent to enhance their distractive effect.

Preferably, the rear panel 16 includes a top collar edge 38 which is located at the wearer's neck when the garment 10 is worn and a bottom collar edge 39 defining a collar width (x). Preferably, the operable closure device 20 is spaced apart from the top collar edge 38 by the predetermined distance (D) sufficient to locate an end 40 of the operable closure device 20 within the inaccessibility zone 24. Preferably, a top edge 22*a* of the cover 22 is disposed at a distance (y) from the bottom collar edge 39, where the distance (y) is greater that the collar width (x). In the exemplary embodiment, the opening 18 extends beyond the operable closure device 20, from the end 40 of the operable closure device 20 to the top collar edge 38. A collar fastener 42 (e.g., a small hook and a small hook) is provided at the top collar edge 38 to hold opposites sides 28,34 of the rear panel 16 together at the top collar edge 38 while the garment 10 is being worn. This arrangement advantageously permits the combination of the neck hole 23 and the opening 18 to serve as one large access opening for donning and removal of the garment 10. The present invention, however, is not limited to the exemplary embodiment. The opening 18, in this regard, can terminate at the end 40 of the closure device 20, or alternatively, somewhere between the closure device 20 and the collar edge 38.

According to yet another embodiment of the present invention (not shown), the collar edge 38 may extend down to the closure device 20, thereby eliminating the distance D between the closure device 20 and the collar edge 38.

As shown in FIG. 1, the front panel 14 can include one or more benign closure devices 44 and/or one or more benign fasteners 46. The benign closure devices 44 and fasteners 46 are benign in that they are manually actuatable by the wearer without facilitating unassisted disrobing. That is, no disrobing occurs as a result of the wearer playing with the benign closure devices 44 and fasteners 46.

Preferably, the front and/or rear panels 14,16 carry decorative features 48–62 that simulate traditional clothing. Front panel 14, for example, carries a vertical line 48 of buttons 46 (e.g., the benign fasteners 46), belt loops 50, a simulated belt 52 with belt buckle 54, two pockets 56, and a winged collar 58. Rear panel 16 carries, for example, a raised collar 60, belt loops 50, and a back portion 62 of the simulated belt 52. Preferably, the decorative features 48–62 which simulate traditional clothing are permanently sewn onto the garment material 12. The present invention, however, is not limited in this regard. Alternative methods of securing the decorative features 48–62 to the garment material 12 can be used.

Preferably, the decorative features 48–62 carried by versions of the garment 10 which are intended for women are more consistent with the decorative features typically found on womens' clothing. Likewise, the decorative features 48–62 carried by versions of the garment 10 which are intended for men preferably are more consistent with decorative features typically found on mens' clothing.

The belt 52 can be sewn or otherwise secured permanently to the garment material 12 to thereby prevent removal. Preferably, the belt buckle 54 is arranged to permit buckling and unbuckling by the wearer. Should the wearer (e.g., an Alzheimer's disease patients) become restless—looking for something to manipulate with his/her hands, the ability to unbuckle and buckle the belt buckle 54, along with the ability to manipulate the benign fasteners 46 and the benign closure devices 44, provide relatively safe and handy objects for such manual activity.

The actuator 26 preferably is movable in a keyless manner along the operable closure device 20 to open or close the opening 18, without negatively impacting its ability to prevent unassisted disrobing. The ability to prevent unassisted disrobing is preserved, despite the keyless operation of the closure device 20, because the actuator 26, when in the closed position, remains substantially out the wearer's reach (in the inaccessibility zone 24), because the cover 22 also provides protection from the wearer's reach, and/or because of the distracting effect provided by the simulated fasteners 36, along with the benign fasteners 46 and/or benign closure devices 44. Since the exemplary embodiment of the garment 10 provides keyless operation, it is more consistent with the regulations prohibiting restraint garments and locking mechanisms on garments in the assisted-living environment. Another advantage of keyless operation is that the wearer can be assisted by anyone willing to help. Should an emergency arise requiring immediate removal of the garment 10, there is no need to frantically search for a key or for a particular person carrying the key.

While the present invention preferably is implemented using all of the features described and shown in FIGS. 1–3, it is understood that the invention is not limited to such arrangements. The present invention may be practiced using one or any combination of the foregoing features.

By making the garment 10 resemble traditional clothing, the less dignified look and feel associated with restraint garments or conventional hospital garments is avoided. The resulting garment 10 therefore helps preserve the wearer's dignity, while advantageously restricting unassisted disrobing in a keyless manner.

While this invention has been described as having a preferred design, it is understood that the invention is not limited to the illustrated and described features. To the contrary, the invention is capable of further modifications, usages, and/or adaptations following the general principles of the invention and therefore includes such departures from the present disclosure as come within known or customary practice in the art to which the invention pertains, and as may be applied to the central features set forth above, and which fall within the scope of the appended claims.

I claim:

1. A garment adapted to restrict unassisted disrobing by a wearer, said garment comprising:

a front panel of clothing material adapted to cover at least a front portion of the wearer's body;

a rear panel of clothing material adapted to cover at least a rear portion of the wearer's body;

a collar folded over a portion of said front and rear panels and at least partially circumscribing a neck of the wearer's body, said collar defining a collar width along said rear panel wherein said collar width extends from a top edge to a bottom edge of said collar;

an opening in said rear panel to facilitate donning of the garment;

an operable closure device located at said opening and operable to at least partially close said opening to thereby prevent removal of the garment, said operable closure device terminating within an inaccessibility zone of the rear panel, said inaccessibility zone being arranged so that, when the garment is donned, the inaccessibility zone is located between the wearer's shoulder blades at a predetermined distance from the neck of the wearer, said operable closure device having an actuator which is movable along the operable closure device to effect opening or closing of the opening; and a cover for the actuator of the operable closure device, said cover being located substantially at said inaccessibility zone, said cover being selectively closable via an operable closure member to prevent access to the actuator when the actuator is positioned in the inaccessibility zone;

at least one simulated closure member disposed on said cover adjacent said operable closure member to distract the wearer from said operable closure member, wherein said cover defines a rectangular flap having a top horizontally oriented edge disposed a predetermined distance from said lower edge of the collar, and wherein said predetermined distance is greater than said collar width.

2. The garment of claim 1, wherein said operable closure device is a zipper which is closed when the actuator of the zipper reaches the inaccessibility zone.

3. The garment of claim 1, wherein said cover is secured to the rear panel on one side of the opening and extends across at least a portion of said opening in the inaccessibility zone, said garment further comprising at least one operable fastener adapted to removably secure the cover to said rear portion at an opposite side of the opening.

4. A garment adapted to restrict unassisted disrobing by a wearer, said garment comprising:

a front panel of clothing material adapted to cover at least a front portion of the wearer's body;

a rear panel of clothing material adapted to cover at least a rear portion of the wearer's body;

an opening in said rear panel to facilitate donning of the garment;

an operable closure device located at said opening and operable to at least partially close said opening to thereby prevent removal of the garment said operable closure device extending into an inaccessibility zone of the rear panel, said inaccessibility zone being arranged so that, when the garment is donned, the inaccessibility zone is located between the wearer's shoulder blades at a predetermined distance from the neck of the wearer, said operable closure device having an actuator which is movable along the operable closure device to effect opening or closing of the opening; and a cover for the actuator of the operable closure device, said cover being located substantially at said inaccessibility zone, said cover being selectively closable to prevent access to the actuator when the actuator is positioned in the inaccessibility zone, wherein said cover is secured to the rear panel on one side of the opening and extends across at least a portion of said opening in the inaccessibility zone, said garment further comprising at least one operable fastener adapted to removably secure the cover to said rear portion at an opposite side of the opening wherein said cover further includes a plurality of simulated fasteners adapted to distract the wearer from said at least one operable fastener and to reduce a possibility that the wearer will locate said operable fastener, said plurality of simulated fasteners having an appearance and feel substantially identical to said operable fastener to increase a difficulty for the wearer to distinguish said operable fastener from said simulated fasteners.

5. The garment of claim 1, further comprising at least one simulated fastener to distract the wearer from said actuator of the closure device.

6. The garment of claim 1, wherein said operable closure device is a zipper which is closed when the actuator of the zipper reaches the inaccessibility zone.

7. The garment of claim 1, wherein said rear panel includes a collar edge which is located at the wearer's neck when the garment is worn, said operable closure device being spaced apart from said collar edge by a predetermined distance sufficient to locate an end of the operable closure device in said inaccessibility zone.

8. The garment of claim 7, wherein said opening extends between said end of the operably closure device and said collar edge, said garment further comprising a fastening element adapted to join opposites sides of said opening at said collar edge.

9. The garment of claim 8, wherein said operable closure device is a zipper which is closed when the actuator of the zipper reaches said end.

10. The garment of claim 7, wherein said operable closure device is a zipper which is closed when the actuator of the zipper reaches said end.

11. The garment of claim 1, wherein said back and front panels are connected to one another so that, when the garment is worm, the garment covers a majority of the wearer's torso and pelvic area.

12. The garment of claim 1, wherein said front panel includes at least one closure device or fastener which is manually actuatable by the wearer without facilitating unassisted disrobing.

13. The garment of claim 1, wherein said front and rear panels carry decorative features to simulate traditional clothing.

14. A garment adapted to restrict unassisted disrobing by a wearer, said garment comprising:

clothing material adapted to cover a portion of the wearer's body;

an opening in said clothing material to facilitate donning of the garment;

an operable closure device located at said opening and operable to at least partially close said opening to thereby prevent removal of the garment, said operable closure device having an actuator which is movable along the operable closure device to effect opening or closing of the opening;

a cover for the actuator of the operable closure device, said cover being adapted to extend over said actuator and prevent operation of said actuator when the actuator is positioned so as to effect closure of the operable closure device, said cover being secured to the clothing material on one side of the opening;

at least one operable fastener removably securing the cover to the clothing material at an opposite side of the opening, while the cover extends over the actuator, said operable fastener defining an appearance and feel on said cover; and at least one simulated fastener on the cover, to distract the wearer from said at least one operable fastener and from the operable closure device and to reduce a possibility that the wearer will locate said operable fastener, said plurality of simulated fasteners having a simulated appearance and feel substantially identical to said appearance and feel of said operable fastener to increase a difficulty for the wearer to distinguish said operable fastener from said simulated fasteners.

15. The garment of claim 14, wherein said operable closure device is a zipper which is closed when the actuator of the zipper is under said cover.

16. The garment of claim 14, wherein said clothing material is arranged so that, when the garment is worn, the garment covers a majority of the wearer's torso and pelvic area.

17. The garment of claim 14, wherein said clothing material further includes:

a front portion adapted to cover a front portion of the wearer' body when the garment is worn; and at least one closure device or fastener on said front portion, which is manually actuatable by the wearer without facilitating unassisted disrobing.

18. The garment of claim 14, wherein said clothing material carries decorative features to simulate traditional clothing.

19. A garment adapted to restrict unassisted disrobing by a wearer and adapted to facilitate assisted disrobing in a keyless manner, said garment comprising:

a front panel of clothing material adapted to cover at least a front portion of the wearer's body, said front panel extending continuously across and covering at least a portion of said wearer's arms, legs, torso and pelvic region;

a rear panel of clothing material adapted to cover at least a rear portion of the wearer's body, said rear panel extending continuously across and covering at least a portion of said wearer's arms legs torso and pelvic region;

at least one simulated closure device disposed on said front panel and overlying at least one of said wearer's arms and legs to distract the wearer from said operable closure device, said simulated closure device functioning as an operative device without permitting removal of the garment and access to the interior of the garment;

an opening in said rear panel to facilitate donning of the garment;

an operable closure device located at said opening and operable to at least partially close said opening to thereby prevent removal of the garment, said operable closure device extending into an inaccessibility zone of the rear panel, said inaccessibility zone being arranged so that, when the garment is donned, the inaccessibility zone is located between the wearer's shoulder blades at a predetermined distance from the neck of the wearer, said operable closure device having an actuator which is movable along the operable closure device to effect opening or closing of the opening in a keyless manner; and a cover for the actuator of the operable closure device, said cover being located substantially at said inaccessibility zone, said cover being selectively closable to prevent access to the actuator when the actuator is positioned in the inaccessibility zone.

20. The garment of claim 19, wherein said at least one simulated closure device disposed on said front panel further overlies at least one of said wearer's torso and pelvic region to distract the wearer from said operable closure device.

* * * * *